US008047741B2

(12) United States Patent
Von Schönebeck et al.

(10) Patent No.: US 8,047,741 B2
(45) Date of Patent: Nov. 1, 2011

(54) ROAD-MILLING MACHINE OR MACHINE FOR WORKING DEPOSITS

(75) Inventors: Winfried Von Schönebeck, Vettelschoss (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 384 days.

(21) Appl. No.: 12/203,981

(22) Filed: Sep. 4, 2008

(65) Prior Publication Data

US 2009/0074510 A1 Mar. 19, 2009

(30) Foreign Application Priority Data

Sep. 14, 2007 (DE) ..... 10 2007 044 090

(51) Int. Cl.

| | |
|---|---|
| ***E01C 23/07*** | (2006.01) |
| ***E01C 23/08*** | (2006.01) |
| ***E01C 23/16*** | (2006.01) |
| ***E21C 25/00*** | (2006.01) |

(52) U.S. Cl. ..... 404/84.05; 404/90; 404/93; 299/39.4

(58) Field of Classification Search ..... 404/84.05, 404/84.2, 90, 93, 112; 299/39.1, 39.4, 39.5
See application file for complete search history.

(56) References Cited

U.S. PATENT DOCUMENTS

| | | | | |
|---|---|---|---|---|
| 3,414,327 | A | 12/1968 | Austin | |
| 3,914,064 | A | 10/1975 | Gurries | |
| 4,041,623 | A | 8/1977 | Miller et al. | |
| 4,403,889 | A * | 9/1983 | Gillotti | 404/72 |
| 4,933,853 | A * | 6/1990 | Musil et al. | 701/50 |
| 4,948,292 | A * | 8/1990 | Haven et al. | 404/84.2 |
| 5,327,345 | A | 7/1994 | Nielsen et al. | |
| 5,333,966 | A * | 8/1994 | St-Louis et al. | 404/84.05 |
| 5,362,176 | A | 11/1994 | Sovik | |
| 5,378,081 | A | 1/1995 | Swisher, Jr. | |
| 5,430,651 | A | 7/1995 | Nielsen et al. | |
| 6,997,641 | B2 * | 2/2006 | Gaertner et al. | 404/93 |
| 7,140,693 | B2 * | 11/2006 | Dubay et al. | 299/39.1 |
| 7,748,789 | B2 * | 7/2010 | Freeburn | 299/39.5 |
| 2008/0008527 | A1 * | 1/2008 | Kraemer et al. | 404/94 |

OTHER PUBLICATIONS

Exhibit A: The International Search Report from corresponding European Patent Application EP 08 01 2356.

* cited by examiner

*Primary Examiner* — Thomas Will
*Assistant Examiner* — Abigail A Risic
(74) *Attorney, Agent, or Firm* — Waddey & Patterson, P.C.; Lucian Wayne Beavers

(57) ABSTRACT

The invention relates to a road-milling machine or machine for working deposits, such as deposits of coal, ores, minerals, etc. by surface mining. The machine according to the invention has an arrangement 14 for detecting the path followed by a milled edge 13 of a milled strip, with the arrangement for detecting the path followed by the milled edge having means 14 for measuring the distance between at least one reference point I on the machine and the milled edge. The means 14 for detecting the path followed by the milled edge co-operate with the arrangement 6 for steering the track-laying units 3A, 3B in such a way that the machine follows the path followed by the milled edge. The distance between the at least one reference point on the machine and the milled edge can be set in such a way that milled strips situated alongside one another are exactly aligned relative to one another.

15 Claims, 4 Drawing Sheets

ROAD-MILLING MACHINE OR MACHINE FOR WORKING DEPOSITS

FIELD OF INVENTION

The invention relates to a road-milling machine or a machine for working deposits such for example as deposits of coal, ore, minerals, etc. by surface mining.

BACKGROUND OF THE INVENTION

There are various kinds of self-propelled machines for milling which are known. These machines include, in particular, road-milling machines, which can be used to remove existing layers of the surfacing structure of roads, and machines for working deposits by surface mining.

Road-milling machines have a milling arrangement which has a mechanically or hydraulically driven milling drum. The machines for working deposits by surface mining, which are referred to as surface miners, also have a milling arrangement having a milling drum, which is also referred to as a cutting drum in the case of a surface miner. The milling drums of road-milling machines and surface miners are fitted with tool holders to receive the milling tools.

The milling drums of road-milling machines or machines for working deposits are of a preset working width which corresponds to the width of the milling drum. When the machine is being used, the problem arises that the surfaces on which work is to be done are of a size whose width is a multiple of the working width of the machine. For work to be done on the entire surface, it is then necessary for a plurality of strips situated alongside one another to be milled. This calls for the machine to be accurately guided, because the individual milled strips have to be exactly aligned relative to one another. On the one hand the milled strips should extend alongside one another so close together that an unworked area is not left between the strips, but on the other hand the milled strips should not overlap, which would mean that productivity would be reduced. What is aimed for in practice is only a very small overlap, in order to ensure that, while productivity is high, work is done on the whole of the surface.

In the case of the known road-milling machines and machines for working deposits, what is done to work on a surface in a plurality of successive milled strips is that the driver of the machine strikes a visual balance between the dimensions of the machine and the surface to be worked on. Making this balance is a great strain on the driver and is tiring because, as well as the other jobs he has to do such as coordinating the unloading of the material picked up and doing the levelling, he also has to steer the machine exactly over the entire distance over which milling takes place. The driver is always faced with a conflict in this case, in that drifting into the strip milled previously will reduce efficiency but drifting in the opposite direction will result in work not being done on the whole of the surface. In the case of a milling machine which has an edge guard, there is also a risk of the machine being seriously damaged if the edge guard is pulled off.

U.S. Pat. No. 4,041,623 describes a track-laying road-milling machine which has provision for automatic presetting of the direction of travel. However, this presupposes that there is a tensioned cord which is fastened to posts which are arranged at a distance from one another along the desired strip to be milled. The arrangement for controlling the steering arrangement has a sensing arrangement having a sensing member which slides along the tensioned cord. The steering arrangement for steering the track-laying units is controlled in such a way that the machine follows the path of the cord exactly. It is true that the known road-milling machine allows the direction of travel to be controlled exactly but the need to have to tension a cord along the desired strip to be milled is found to be a disadvantage.

The object underlying the invention is to provide a road-milling machine or machine for working deposits which enables work to be done efficiently even on wide surfaces.

This object is achieved in accordance with the invention by virtue of the features of claim 1 the independent claims. Advantageous embodiments form the subject matter of the dependent claims.

SUMMARY OF THE INVENTION

The road-milling machine or machine for working deposits according to the invention is distinguished by the fact that the doing of work efficiently on a wide surface does not call for any preparatory measures such for example as the tensioning of a cord or the like. The machine according to the invention can be operated in the same way as the known working machines but allows the machine to be guided automatically so that the individual milled strips are situated exactly alongside one another.

The machine according to the invention has an arrangement for detecting the path followed by a milled edge of a milled strip, the arrangement for detecting the path followed by the milled edge having means for measuring the distance between at least one reference point on the machine and the milled edge. The arrangement for detecting the path followed by the milled edge co-operates with the arrangement for steering the track-laying units in such a way that the machine follows the path followed by the milled edge.

The distance between the at least one reference point on the machine and the milled edge can be set in such a way that the milled strips which are situated alongside one another are exactly aligned relative to one another. The distance to be set depends in this case on where the at least one reference point on the machine is situated.

Basically, it is enough for only one reference point to be laid down. It is however also possible for a plurality of reference points to be laid down to allow the distance to be determined at various points. These values can be analysed statistically and the mean may be formed for example. The milled edge too may have one or more reference points associated with it.

In a preferred embodiment, provision is made for the arrangement for detecting the path followed by the milled edge to have an arrangement for monitoring distance which compares the measured distance between the at least one reference point and the milled edge with a desired distance. The arrangement for monitoring distance then co-operates with the arrangement for steering the track-laying units in such a way that the track-laying units are so steered that the distance measured corresponds to the desired distance. The arrangement for monitoring distance is preferably so designed that it co-operates with the arrangement for steering the track-laying units only when the distance between the at least one reference point and the milled edge is within preset limits. If the distance is outside preset limits, being for example outside the range of measurement of the means for measuring distance, or if no value is being found for the distance, then there is thus no automatic control. An alarm can be given in this case. The driver can then steer the machine manually.

The means for measuring the distance between the reference point on the machine and the milled edge may take different forms. Basically, any means by which the milled edge can be detected can be used. In a particularly preferred embodiment of machine according to the invention, a mechanical sensing arrangement having a mechanical sensing member is provided. As well as a mechanical sensing arrangement, electrical or electronic sensing arrangements having electrical or electronic "sensing members" may also be provided. The ultrasonic sensors which are known from ultrasonic measurement arrangements or the capacitive sensors known from capacitive proximity switches may for example be used to determine the distance. It is also possible for the milled edge to be sensed by means of a laser or a radar. What are particularly obvious candidates for detecting the milled edge are the known laser triangulation sensors. By the use of modern-day image-processing techniques, it is also possible for cameras to be used by which the milled edge can be detected and the distance determined.

In a preferred embodiment, an arrangement is provided by which the sensing member, which is preferably mechanical, can be moved in the horizontal plane. This makes it possible for the sensing member to be brought up against the vertical face of the milled edge sideways. In a particularly preferred embodiment, the arrangement for moving the sensing member in the horizontal plane has a shaft which can be rotated on a vertical axis, the means for measuring distance having means by which the angular position of the shaft can be determined. It is however also possible for the movement in translation of the sensing member, which can be moved along a rail, to be sensed for the purpose of determining the distance.

The arrangement for moving the sensing member in the horizontal plane preferably has means by which the sensing member can be resiliently preloaded against the milled edge. This ensures that the sensing member also bears against the milled edge even when the milled edge is not flat. The sensing member is preferably resiliently preloaded against the milled edge by a piston-and-cylinder arrangement which at the same time allows the sensing member to be displaced in the horizontal plane. It is however also possible for a spring to be provided to preload the sensing member against the milled edge.

In a road-milling machine or a machine for working deposits which has at the two ends of the milling drum a left-hand and a right-hand edge guard which extend in the longitudinal direction and which have an arrangement for adjusting the said left-hand and right-hand edge guards vertically, the reference point on the machine is preferably a point which is arranged at the bottom end of the right-hand or left-hand edge guard. The advantage that this has is that the reference point is situated immediately adjacent the milled edge.

The reference point is preferably a point which is arranged at that end of the left-hand or right-hand edge guard which is at the front in the direction of travel. The reference point is thus situated ahead of the milling drum in the direction of travel. If only the front track-laying unit is steered, it is of advantage if the reference point is situated directly ahead of the milling drum because, if the milled edge follows an uneven path, this uneven path is not exactly copied but is smoothed out and can be followed to the end of the lane in which milling takes place. The reference point may however also be laid down on the chassis of the machine at a greater distance ahead of the milling drum.

Basically, it is possible not only for the distance from the milled edge of the strip which was milled in the previous pass to be determined but also the distance from the milled edge of the milled strip which is being milled at the time. The steering arrangement for steering the track-laying units can then be controlled as a function of the distance between the old and new milled edges.

In a further particularly preferred embodiment, the arrangement for detecting the path followed by the milled edge has first means for sensing the distance between a reference point which is preferably situated at the bottom end of the left-hand edge guard of the milling machine, and as a particular preference at the bottom front end of its left-hand edge guard, and second means for sensing the distance between a reference point which is preferably situated at the bottom end of the right-hand edge guard of the milling machine, and as a particular preference at the bottom front end of its right-hand edge guard, in which case the first or second means can be activated or de-activated as a function of the direction of travel of the road-milling machine. For further automation, means are provided for measuring the positions of the left-hand and right-hand edge guards. As a function of the direction of travel of the road-milling machine, one of the two edge guards rests on the surface which has already been milled, while the other edge guard rests on the surface which has not yet been worked on. The means for activating the first or second means for measuring the distance between the reference point and the milled edge co-operate with the means for measuring the positions of the right-hand and left-hand edge guards in such a way that those means for measuring distance are activated which are associated with the edge guard which is situated in the lower position, whereas the other means for determining distance, which are associated with the edge guard which is situated in the higher position, are de-activated. This ensures that the side on which the distance from the milled edge is determined is always that which is also being milled. There is thus no need for the driver of the machine to preset the side of the machine on which the distance is to be measured.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

In the drawings.

DETAILED DESCRIPTION OF THE INVENTION

Figure 1:
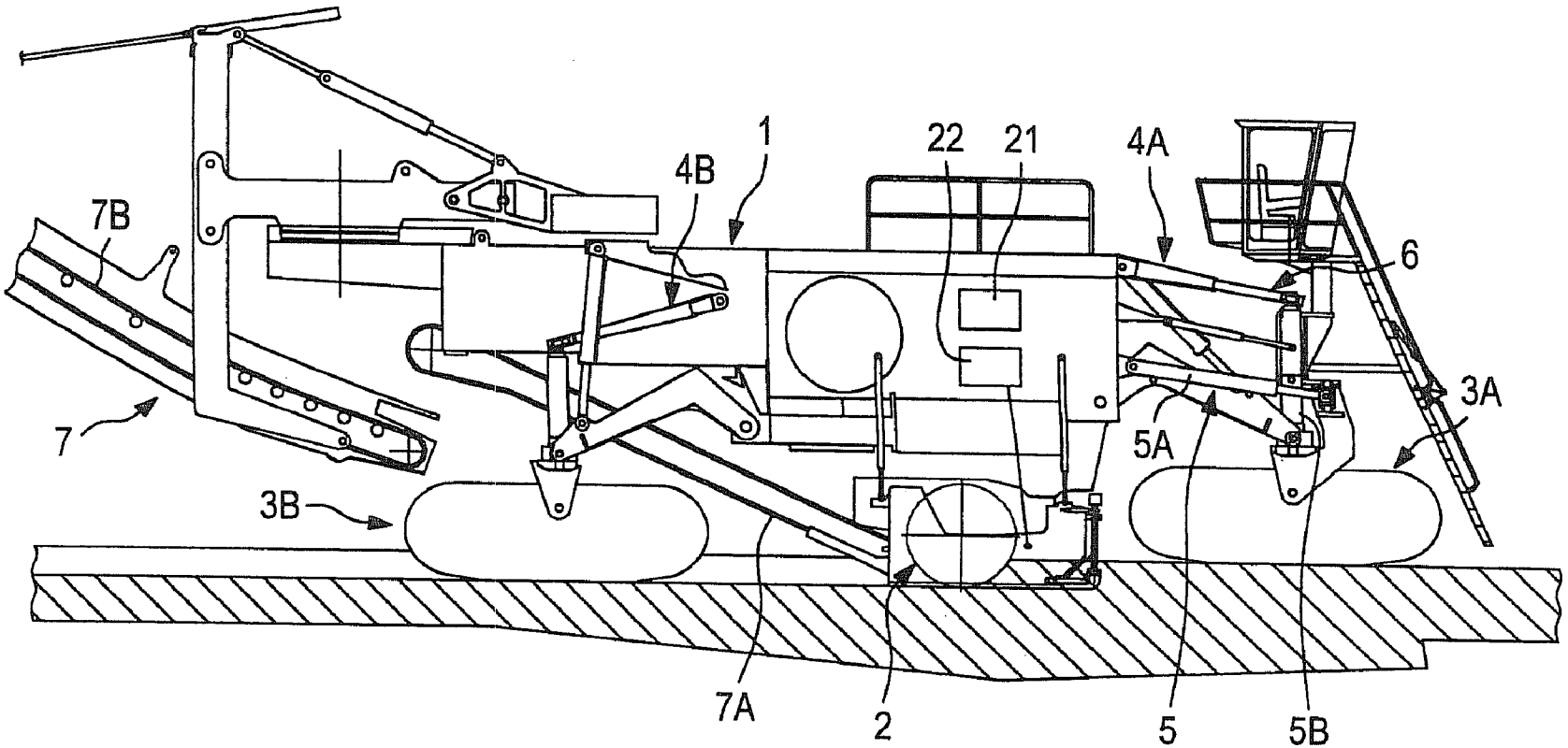
FIG. 1 is a side view of a machine for working deposits.

FIG. 1 is a view from the side showing a machine for working deposits by surface mining, which will be referred to in what follows as a surface miner. The construction and operation of a surface miner are familiar to the person skilled in the art and for this reason it will only be those components of the surface miner which are relevant for the purpose of allowing the invention to be understood that will be described in what follows. A road-milling machine, whose construction and operation are likewise familiar to the person skilled in the art, will not be described because it is only the milling arrangement and the steering arrangement which are relevant to the invention and these do not differ in any fundamental way from the milling and steering arrangements of a surface miner as far as the components relevant to the invention are concerned.

The surface miner for milling or cutting mineral matter has a chassis 1 which is formed by a welded structure stiff in bending. A milling arrangement 2, which is arranged below the chassis, is provided for milling the mineral matter. The depth of cut is set by raising or lowering the chassis 1 and the chassis 1 can be displaced on two front and two rear track-laying units 3A and 3B which are arranged at the front and rear ends of the chassis.

The arrangement for adjusting the height of the chassis 1 has parallelogram mountings associated with the individual track-laying units 3A, 3B, of which the parallelogram mountings arranged at the front end of the chassis are identified by reference numeral 4A and the parallelogram mountings arranged at the rear end of the chassis are identified by reference numeral 4B. The four track-laying units 3A, 3B are suspended from the parallelogram mountings to rock, it being possible for the track-laying units to be moved relative to the chassis in a vertical plane.

To steer the surface miner, the front track-laying units 3A are turned on a vertical axis. For this purpose, there is provided for each front track-laying unit 3A a piston-and-cylinder arrangement 5 whose piston 5A is hingeably connected to the running-gear suspension and whose cylinder 5B is hingeably connected to the chassis. By the actuation of the piston-and-cylinder arrangements 5, the front track-laying units are turned on the vertical axis. Together with hydraulic pumps (not shown) and other components (not shown), the piston-and-cylinder arrangements 5 form the steering arrangement 6 of the machine. To steer the machine, it is also possible for the rear track-laying units 3B to be displaced as well as the front ones.

Figure 2:
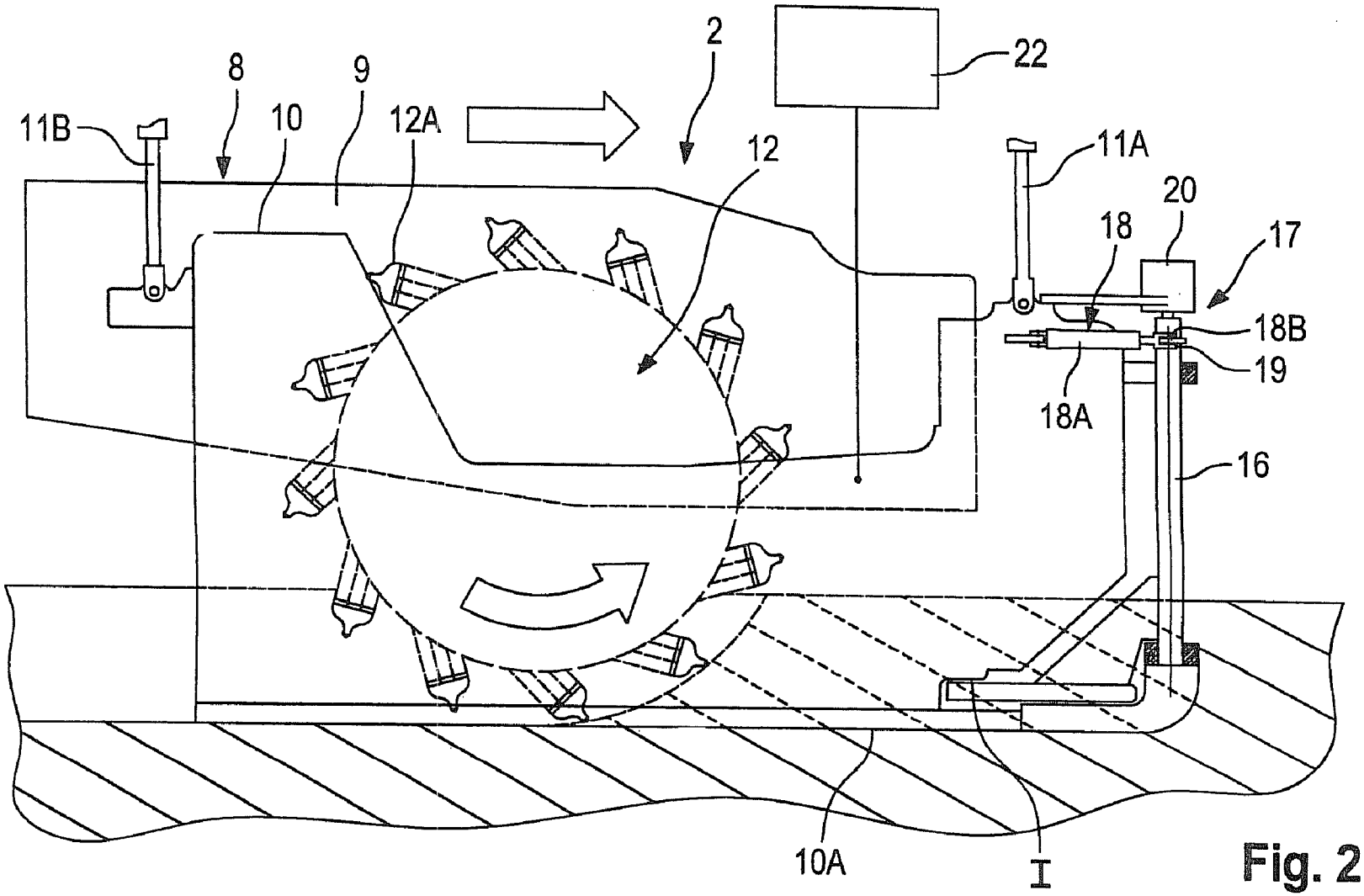
FIG. 2 shows an enlarged detail of FIG. 1 showing the milling arrangement of the machine for working deposits.

The material milled away by the milling arrangement 2 is picking up by a loading arrangement 7, which has a pick-up belt 7A which is situated behind the milling arrangement 3 in the direction of travel and an unloading belt 7B which can be adjusted vertically and which is pivotable. FIG. 2 is an enlarged view from the side of the milling arrangement 2, which is arranged below the chassis 1 between the front and rear track-laying units 3A, 3B. The milling arrangement 2 comprises a milling drum enclosure 8 which has side-walls 9 on the left and right in the direction of travel and a front and a rear wall which cannot be seen in the view from the side. On front of each of the left-hand and right-hand sidewalls 9 of the milling drum enclosure 8 is an edge guard 10. The edge guard 10 is a vertically adjustable plate which can be raised from the ground or lowered onto the ground. The arrangement 11 for adjusting the left-hand and right-hand edge guards 10 vertically has piston-and-cylinder arrangements 11A and 11B which are associated with the left-hand and right-hand edge guards. By the actuation of the piston-and-cylinder arrangements 11A, 11B, the left-hand and right-hand edge guards 10 can be adjusted vertically.

Figure 3A:
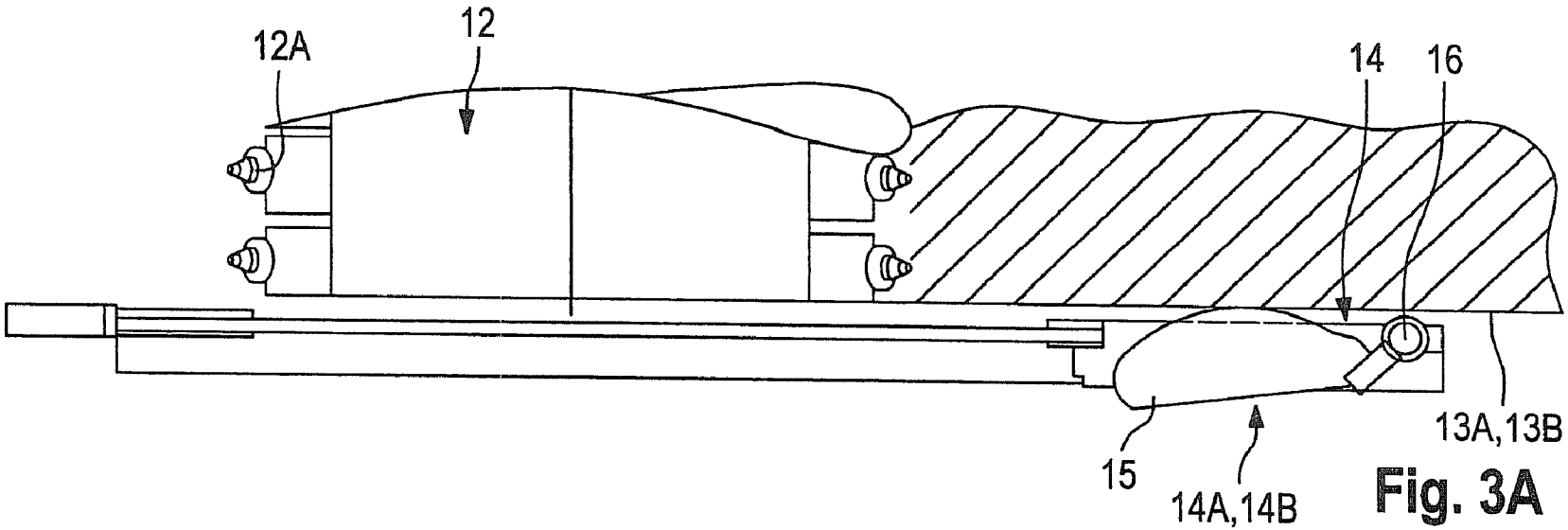
FIG. 3A is a plan view of the milling drum of the machine for working deposits in which a first working position is shown.
Figure 3B:
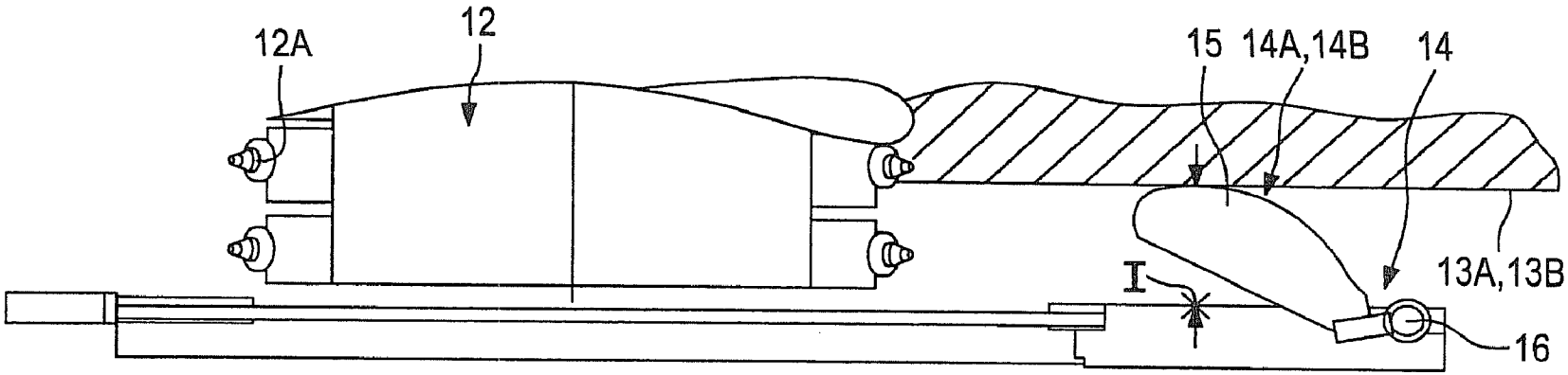
FIG. 3B is a plan view of the milling drum in which a second working position is shown.

The milling drum 12 is mounted between the two side-plates 9 of the milling drum enclosure to be rotatable, with its axis of rotation extending transversely to the direction of travel. The milling drum 12 has, distributed around its circumference, milling tools 12A by which the mineral matter is comminuted. FIGS. 3A and 3B are plan views showing a portion of the milling drum 12 and the milling tools 12A. The milling drum of a road-milling machine likewise has milling tools for comminuting the material of the carriageway. In this regard the milling arrangements of the two machines do not differ from one another.

During the milling operation, the machine for working deposits moves in the direction of travel at a relatively low speed of advance. The bottom edges 10A of the right-hand and left-hand edge guards 10 rest on the ground at this time on the two sides of the milled edges.

Figures 4A, 4B, 4C, 5:
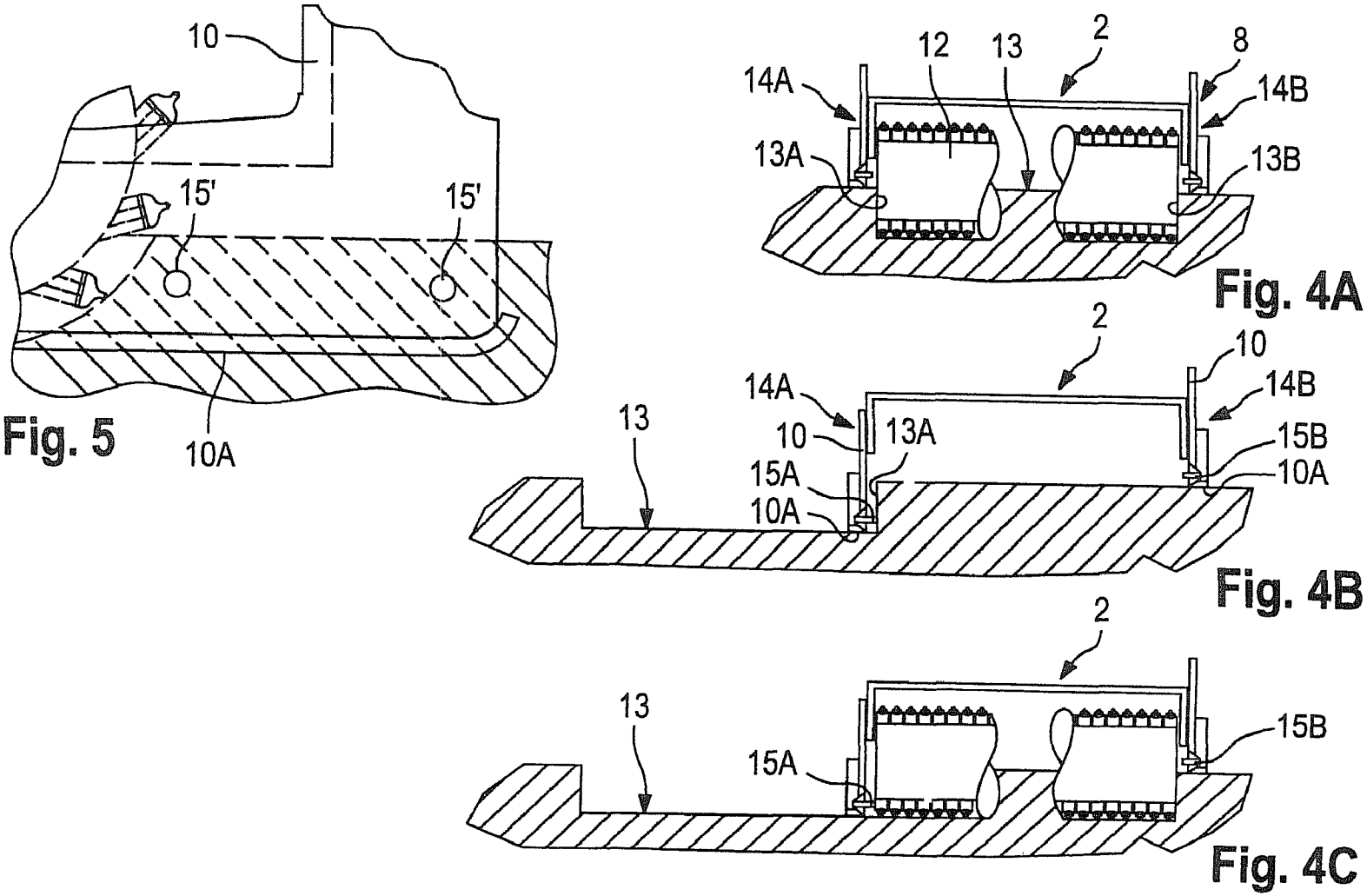
FIG. 4A is a view looking in a direction from behind the milling drum, showing the milling drum enclosure and the milling drum of the machine for working deposits during the milling of a first milled strip.
FIG. 4B is a view looking in the direction of travel from in front of the milling drum showing the milling drum enclosure when a second milled strip situated alongside the first milled strip is being milled.
FIG. 4C is a view looking from behind the milling drum showing the milling drum during the milling of the second milled strip.
FIG. 5 is a schematic view showing an embodiment having two ultrasonic sensors for measuring distance.

FIG. 4A is a view from the rear, looking in the direction of travel, of the milling drum enclosure 8 belonging to the milling arrangement 2 and of the milling drum 12. The left-hand and right-edge milled edges of the milled strip 13 are identified by reference numerals 13A and 13B respectively. What are considered the milled edges in the present case are the vertical surfaces at the two ends of the milling drum, i.e. the surfaces facing the end-faces of the milling drum. The width of the milled strip 13 corresponds to the distance between the two milled edges 13A and 13B. This is the working width of the machine. If work is to be done on a surface which is wider than the working width of the machine, a plurality of milled strips which extend parallel to one another are milled.

FIGS. 4B and 4C show how the second milled strip is milled. FIG. 4B is a view from in front of the milling drum, looking in the direction of travel, whereas FIG. 4B is a view from behind the milling drum, looking in the direction of travel. Ideally, the milled strip on the left should end exactly where the milled strip on the right begins. This presupposes exact steering of the machine.

The machine according to the invention has an arrangement 14 for detecting the path followed by the milled edge of the milled strip. The arrangement 14 for detecting the path following by the milled edge has means 14A, 14B by which the distance is determined between a reference point I on the machine, which is preferably situated at the bottom front end of the edge guard 10, and the milled edge 13A, 13B. Means 14A, 14B of this kind are provided at both ends of the milling drum 12. They each have a mechanical sensing member 15 in the form of a paddle which is pivotable in the horizontal plane. The sensing member 15 is fixed to the bottom end of a vertical shaft 16 which is mounted to be rotatable ahead of the edge guard 10 in the direction of travel. As well as the shaft 16, the arrangement 17 for moving the sensing member 15 also comprises a piston-and-cylinder arrangement 18 whose cylinder 18A is rotatably fastened to the edge guard 10 and whose piston 18B is rotatably fastened to a lever 19 which projects from the top end of the shaft 16. By the extension and retraction of the piston 18B of the piston-and-cylinder arrangement 18, the sensing member 18 is held against the milled edge 13. The sensing member is resiliently preloaded against the milled edge by means of the piston-and-cylinder arrangement, which means that the sensing member follows the path followed by the milled edge as the machine advances. In the course of this, the sensing member slides over the milled edge as the machine advances. Because, in the direction of travel, the point at which the sensing member turns is situated in front of the point at which it bears against the milled edge, the sensing member is drawn along the milled edge, which means that it cannot tilt against unevennesses on the milled edge.

Mounted on the shaft 16 is an angle encoder 20 by which the angular position of the shaft is measured. The angular position of the shaft corresponds to the distance between the milled edge 13 and the reference point I. However, instead of angular position being measured by an angle encoder, travel may equally well be measured from the position of the piston 18B in the piston-and-cylinder arrangement 18.

The arrangement 14 for detecting the path followed by the milled edge has an arrangement 21 for monitoring distance which is merely indicated in FIG. 1 and which co-operates with the arrangement 6 for steering the front track-laying units 3A and 3B. The arrangement 21 for monitoring distance compares the distance which is measured between the reference point I and the milled edge 13A or 13B with a desired value for the distance between the reference point and the milled edge. As a function of the difference between the distance measured and the distance which is preset, the arrangement 6 for steering the track-laying units controls the piston-and-cylinder arrangements 5 to turn the track-laying units in such a way that the distance measured corresponds to the distance which is preset during the milling operation. When this is the case, the machine moves along the milled edge of the previous milled strip, and the previous and succeeding milled strips are thus situated exactly alongside one another.

If the value found for distance is outside preset limits and/or a value for distance is not determined, the arrangement 14 for detecting the path followed by the milled edge does not actuate the arrangement 6 for steering the track-laying units. This may for example be the case if the milled edge is outside the range of measurement. If this is the case, an alarm is given which indicates that the steering of the machine will now be performed manually. This rules out the possibility of the automatic steering of the machine causing the direction of milling to be wrong. The arrangement 14 for detecting the path followed by the milled edge is so designed that the automatic steering of the steering arrangement is suspended the moment the driver intervenes in the steering of the machine, i.e. actuates the controls for steering the machine.

To enable work to be done in different directions, the distance between the reference point and the milled edge can be measured on both sides of the milling drum enclosure. For this purpose, corresponding sensing members and arrangements for moving the sensing members are provided on both sides of the milling drum enclosure. However, only one of the two sensing members is required when milling is taking place. The machine according to the invention makes provision for one of the two sensing members to be selected automatically.

FIGS. 4B and 4C show that the left-hand edge guard 10 rests on the strip 13 milled previously by its bottom edge 10A, whereas the right-hand edge guard 10 rests on the surface which has still to be worked on by its bottom edge 10A. Consequently, the left-hand edge guard is situated in the lower position and the right-hand edge guard in the upper position. The machine according to the invention has means for measuring the position of the left-hand and right-hand edge guards, which are merely indicated in FIG. 1 and which are preferably cable-traction sensors 22 whose cables are fastened to the left-hand and right-hand edge guards respectively. The cable-traction sensors 22 co-operate with the means 14A and 14B for measuring distance in such a way that those means 14A or 14B are activated which are associated with the edge guard which is situated in the lower position and at the same time those means are deactivated which are associated with the edge guard which is situated in the upper position. In the present embodiment, the sensing member 15A which is arranged ahead of the left-hand edge guard 10 rests against the milled edge 13A, thus enabling the distance between the reference point and the milled edge to be measured, whereas the sensing member 15B arranged ahead of the right-hand edge guard is not active.

In the case of the embodiment described, it is assumed that the milled edge can be considered a vertical, plane surface. It is therefore enough for only one reference point to be laid down on the milled edge. It is however also possible for a plurality of reference points to be laid down, in which case the values which are found for distance can be analysed statistically, and for example the mean of the values found can be determined.

FIG. 5 is a simplified schematic view showing the region of the bottom front end of one of the two edge guards 10 in an embodiment in which the means for measuring distance have two distance-measuring arrangements which operate without making physical contact and which have non-contacting ultrasonic sensors 15' which are arranged at a distance from one another at the bottom front end of whichever edge guard 10 is concerned. In this embodiment, the means for measuring distance have means which calculate a mean, or even some other characteristic variable, from the values for distance which are measured by the two sensors 15'.

We claim:

1. A milling machine for milling a ground surface, comprising:

a chassis having a direction of travel;

a running gear supporting the chassis and including front and rear track-laying units;

a rotatable milling drum supported from the chassis between the front and rear track-laying units, the drum having a working width for milling a strip from the ground surface, the strip having two substantially vertical milled edges;

a steering system operable to steer at least one of the track-laying units;

a mechanical sensing member pivotable about a vertical axis and operable to engage one of the previously milled edges of a previously milled strip;

a sensor associated with the sensing member and operable to detect an angular position of the sensing member about the vertical axis;

a controller operably associated with the sensor and the steering system, the controller operable to steer the machine so that the machine follows a path defined by the previously milled edge engaged by the pivotable sensing member;

a left-hand edge guard and a right-hand edge guard extending longitudinally adjacent two ends of the milling drum;

a second sensing member, the first and second sensing members being connected to the left and right edge guards, respectively, the first and second sensing members being selectively activateable; and vertical adjustment mechanisms operably associated with the edge guards for adjusting vertical positions of the edge guards;

wherein the controller is operable to detect one of the edge guards being in a higher position and the other of the edge guards being in a lower position, and the controller is operable to activate the pivotable sensing member associated with the edge guard in the lower position.

2. The machine of claim 1, wherein:

the controller is operable to measure a distance between at least one reference point on the machine and the previously milled edge engaged by the pivotable sensing member and to compare the measured distance with a preset desired value for said distance, and to steer the at least one track-laying unit such that the measured distance approaches the preset desired value.

3. The machine of claim 2, wherein:

the controller is operable to steer the at least one track laying unit only when the distance between the at least one reference point and the previously milled edge is within preset limits.

4. The machine of claim 1, further comprising:

a resilient biasing member operably associated with the pivotable sensing member and operable to bias the pivotable sensing member against the previously milled edge.

5. The machine of claim 1, wherein:

each of the sensing members is arranged so that each sensing member when activated engages the previously milled edge adjacent a lower end of the respective edge guard to which each pivotable sensing member is connected.

6. The machine of claim 1, wherein:

each of the sensing members is arranged so that each sensing member when activated engages the previously milled edge forward of the milling drum in the direction of travel.

7. A milling machine for milling a ground surface, comprising:

a chassis having a direction of travel;

front and rear ground engaging supports supporting the chassis from the ground surface;

a rotatable milling drum supported from the chassis between the front and rear ground engaging supports, the drum having a working width for milling a strip from the ground surface, the strip having two substantially vertical milled edges;

first and second vertically adjustable edge guards supported from the chassis adjacent opposite ends of the milling drum, the edge guards extending longitudinally in the direction of travel;

a steering system operable to steer at least one of the ground engaging supports; and an automated steering control system operable to steer the machine so that the machine follows a path defined by one of the milled edges of a previously milled strip, the automated steering control system being operable to measure and control a distance between a first reference point on the first edge guard and the one of the previously milled edges of the previously milled strip;

wherein the automated steering control system is operable to measure and control a distance between a second reference point on the second edge guard and one of the previously milled edges; and wherein the automated steering control system is operable to measure vertical positions of the first and second edge guards and selectively control the distance between the previously milled edge and the one of the reference points on a lower one of the edge guards.

8. The machine of claim 7, wherein:

the automated steering control system is operable to steer the machine only when the distance between one of the reference points and one of the previously milled edges is within preset limits.

9. The machine of claim 7, wherein:

the automated steering control system includes a mechanical sensing member operable to engage one of the previously milled edges.

10. The machine of claim 7, wherein:

the automated steering control system includes a non-contacting sensor operable to measure the distance between the first reference point and one of the previously milled edges without contacting the previously milled edge.

11. The machine of claim 10, wherein:

the non-contacting sensor is an ultrasonic sensor.

12. The machine of claim 7, wherein:

the reference points are located adjacent bottom ends of the edge guards.

13. The machine of claim 7, wherein:

the reference points are located forward of the milling drum.

14. The machine of claim 7, further comprising:

a milling drum enclosure having a left-hand side-wall extending in the direction of travel and a right-hand side-wall extending in the direction of travel; and the first and second edge guards being arranged on the left-hand and right-hand side-walls, respectively.

15. The machine of claim 7, wherein:

the automated steering control system is operable to determine a mean of distances between at least two reference points on the first edge guard and the one of the previously milled edges.

* * * * *

UNITED STATES PATENT AND TRADEMARK OFFICE

CERTIFICATE OF CORRECTION

PATENT NO. : 8,047,741 B2
APPLICATION NO. : 12/203981
DATED : November 1, 2011
INVENTOR(S) : Winfried Von Schonebeck et al.

It is certified that error appears in the above-identified patent and that said Letters Patent is hereby corrected as shown below:

Column 2, line 9, delete "the independent claims" after --claim 1--.

Signed and Sealed this
Thirty-first Day of January, 2012

David J. Kappos

David J. Kappos
*Director of the United States Patent and Trademark Office*